US008333567B2

(12) United States Patent
Watts et al.

(10) Patent No.: US 8,333,567 B2
(45) Date of Patent: Dec. 18, 2012

(54) VISCOUS FLUID PUMP AND RELATED METHODS

(75) Inventors: William C. Watts, Keokuk, IA (US); Ronald C. Bricker, Macomb, IL (US)

(73) Assignee: Ampro Manufacturing, Inc., Bettendorf, IA (US)

( * ) Notice: Subject to any disclaimer, the term of this patent is extended or adjusted under 35 U.S.C. 154(b) by 401 days.

(21) Appl. No.: 12/644,066

(22) Filed: Dec. 22, 2009

(65) Prior Publication Data

US 2011/0150675 A1 Jun. 23, 2011

(51) Int. Cl.
*F04B 7/04* (2006.01)

(52) U.S. Cl. ..... 417/53; 417/490

(58) Field of Classification Search ..... 417/490, 417/501, 53; 92/171.1
See application file for complete search history.

(56) References Cited

U.S. PATENT DOCUMENTS

| | | | | | |
|---|---|---|---|---|---|
| 855,050 | A * | 5/1907 | Dietrich | 417/501 |
| 1,599,625 | A * | 9/1926 | Whitlock | 92/86.5 |
| 2,160,978 | A * | 6/1939 | Mock | 417/269 |
| 2,835,005 | A * | 5/1958 | Green | 222/385 |
| 4,453,454 | A * | 6/1984 | Comer | 92/87 |
| 5,462,199 | A * | 10/1995 | Lenhardt | 222/54 |
| 5,741,126 | A * | 4/1998 | Stearns et al. | 417/490 |
| 6,755,630 | B2 * | 6/2004 | Kim et al. | 417/501 |

* cited by examiner

*Primary Examiner* — Charles Freay
(74) *Attorney, Agent, or Firm* — Wood, Herron & Evans, LLP

(57) ABSTRACT

A viscous fluid pump is provided. The pump has a housing that has an inlet for receiving viscous fluid and an outlet for dispensing viscous fluid. A bushing within the housing has an opening proximate the inlet and which provides access into an inner chamber of the bushing. The opening extends beyond the inlet in a direction orthogonal to the longitudinal dimension of the pump. A piston is movable within the inner chamber, with the piston having a first position in which the inlet is in fluid communication with the inner chamber through the opening and a second position in which the inlet is not in fluid communication with the inner chamber. The housing may define an interior, with the interior of the housing being free of soft seals.

17 Claims, 4 Drawing Sheets

VISCOUS FLUID PUMP AND RELATED METHODS

TECHNICAL FIELD

This invention relates to pumps and, more particularly, to pumps for dispensing controlled amounts of viscous fluids such as grease or silicone.

BACKGROUND

Pumps for dispensing viscous fluids are known. Conventional pumps may receive viscous fluid from an outside source such as a container, for example, that may be connected to the pump through a fitting received in a viscous fluid inlet of an outer shell of the pump. Conventional pumps of this type may have an internal structure such as a sleeve, for example, defining a holding chamber for the viscous fluid. In such pumps, the internal structure may be provided with a bore that may be drilled through the inlet, and which provides fluid communication between the inlet and the holding chamber. In this regard, the shape and dimensions of the bore are dependent on the shape and dimensions of the inlet through which the bore is drilled. This limitation, in turn, makes fluid communication between the inlet and the holding chamber highly dependent on near-perfect alignment between the inlet and the bore. In use, any rotation of the internal structure and/or shell of the pump relative to one another affects fluid communication between the inlet and the holding chamber.

Moreover, conventional pumps are known to include one or more soft seals (e.g., O-rings) in their interior, which prevent viscous fluid from escaping the holding chamber due to pressure and/or the movement of parts in the interior of the pump. Soft seals, however, tend to have a limited life span, thereby necessitating replacement, which also limits the life span or increases the required frequency of maintenance of the pumps of which they form part.

In addition to the above, conventional pumps are known to have complex constructions. These complex constructions, for example, require precise alignment between all components of the pump. Further, these complex constructions are such that cleaning of any component of the pump requires a detailed, complex disassembly, which increases the required down time for the pumps. Moreover, such complex constructions necessitate the replacement of the entire pump when maintenance is required or when a pump capable of dispensing a different amount (i.e., volume) of viscous fluid is desired.

There is thus a need for a viscous fluid pump and related methods that address these and other problems associated with conventional viscous fluid pumps.

SUMMARY

In one embodiment, a viscous fluid pump is provided. The pump has a housing that has an inlet for receiving viscous fluid and an outlet for dispensing viscous fluid. A bushing within the housing has an opening proximate the inlet and which provides access into an inner chamber of the bushing. The opening extends beyond the inlet in a direction orthogonal to the longitudinal dimension of the pump. A piston is movable within the inner chamber, with the piston having a first position in which the inlet is in fluid communication with the inner chamber through the opening and a second position in which the inlet is not in fluid communication with the inner chamber. In one embodiment, the housing may define an interior, with the interior of the housing being free of soft seals.

The opening may be slotted and made additionally or alternatively define a pair of opposed spaced apart walls, with the walls being inwardly tapered toward the inner chamber. In a specific embodiment, movement of the piston from the second position to the first position is configured to generate a vacuum in the inner chamber that is effective to withdraw viscous fluid through the inlet. The piston may be radially spaced from the bushing by a distance not exceeding about 0.0002 inches. Additionally or alternatively, at least one of the piston or the bushing may be made of a metal or a ceramic. The pump may include a check valve proximate the outlet, with movement of the piston from the first position to the second position being effective to move viscous fluid from the inner chamber toward the check valve. In a specific embodiment, the pump includes an air valve that is operatively coupled to a piston and which is effective to move the piston between the first and second positions, and a switch that is operatively coupled to the air valve for energizing the air valve. The switch is actuable by movement of the piston from the first position to the second position or from the second position to the first position so as to cause the air valve to move the piston, respectively, back toward the first position or toward the second position.

Movement of the piston between the first and second positions may define a stroke of the piston, with the pump additionally having a stroke adjustment feature for selectively varying the length of the stroke. The pump, in a specific embodiment, is such that the piston has a proximal end and an opposed distal end, with the distal end of the piston being disposed within the inner chamber and the housing, the bushing, and the piston generally defining a pump dispensing assembly. In this specific embodiment, an actuator body is operatively coupled to the proximal end of the piston and is removably coupled to the pump dispensing assembly for permitting selective coupling of the actuator body with another pump dispensing assembly. Coupling between the actuator body and the pump dispensing assembly may additionally include an axially oriented threaded element. The outlet in another specific embodiment is located at an axial end of the housing.

In another embodiment, a viscous fluid pump is provided. The viscous fluid pump has a housing having an interior, an inlet for receiving viscous fluid, and an outlet for dispensing viscous fluid. The pump has a bushing within the housing, with the bushing having an opening proximate the inlet and providing access into an inner chamber of the bushing, and with the interior of the housing being free of soft seals. A piston is movable within the inner chamber, with the piston having a first position in which the inlet is in fluid communication with the inner chamber through the opening, and a second position in which the inlet is not in fluid communication with the inner chamber. In a specific embodiment, the bushing and at least a portion of the piston disposed within the inner chamber are made of a hard material. The housing, the bushing, and the piston may jointly define a pump dispensing assembly, and the pump may further include an actuator body that is operatively coupled to the piston and which is threadably coupled to the pump dispensing assembly for permitting selective coupling of the actuator body with one of a plurality of pump dispensing assemblies.

In yet another embodiment, a method is provided for constructing a viscous fluid pump that has a housing including an inlet for receiving viscous fluid and an outlet for dispensing viscous fluid, and a piston that is movable within an inner chamber of a bushing in the interior of the housing. The method includes defining an opening in the bushing to provide access into the inner chamber, and subsequently disposing the bushing into the interior of the housing so as to place the inlet in fluid communication with the inner chamber. The method includes disposing the piston within the inner chamber of the bushing, such that movement of the piston selectively opens and closes fluid communication of the inlet with the inner chamber through the opening.

In a specific embodiment, the housing, the bushing, and the piston jointly define a pump dispensing assembly, and the method further includes obtaining an actuator body, and releasably coupling the actuator body to the pump dispensing assembly to thereby define an operative coupling of the actuator body with the piston. The method may, additionally or alternatively, include releasably coupling the actuator body to the pump dispensing assembly by rotating the actuator body relative to the housing. The method may include securing the piston within the housing, and maintaining the interior of the housing free of soft seals when the piston is secured therein.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
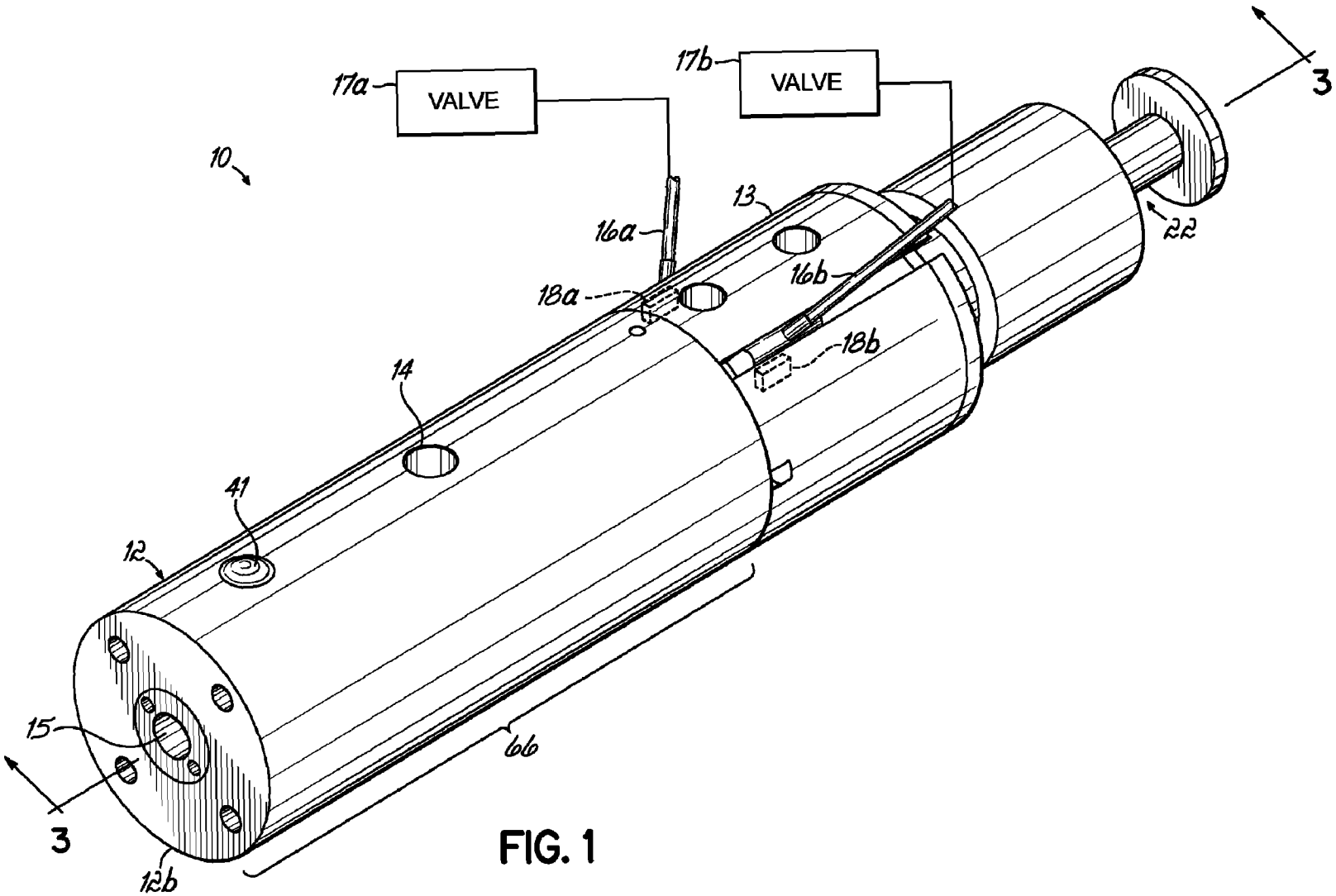
FIG. 1 is a perspective view of one embodiment of a viscous fluid dispensing apparatus or pump.
Figure 2:
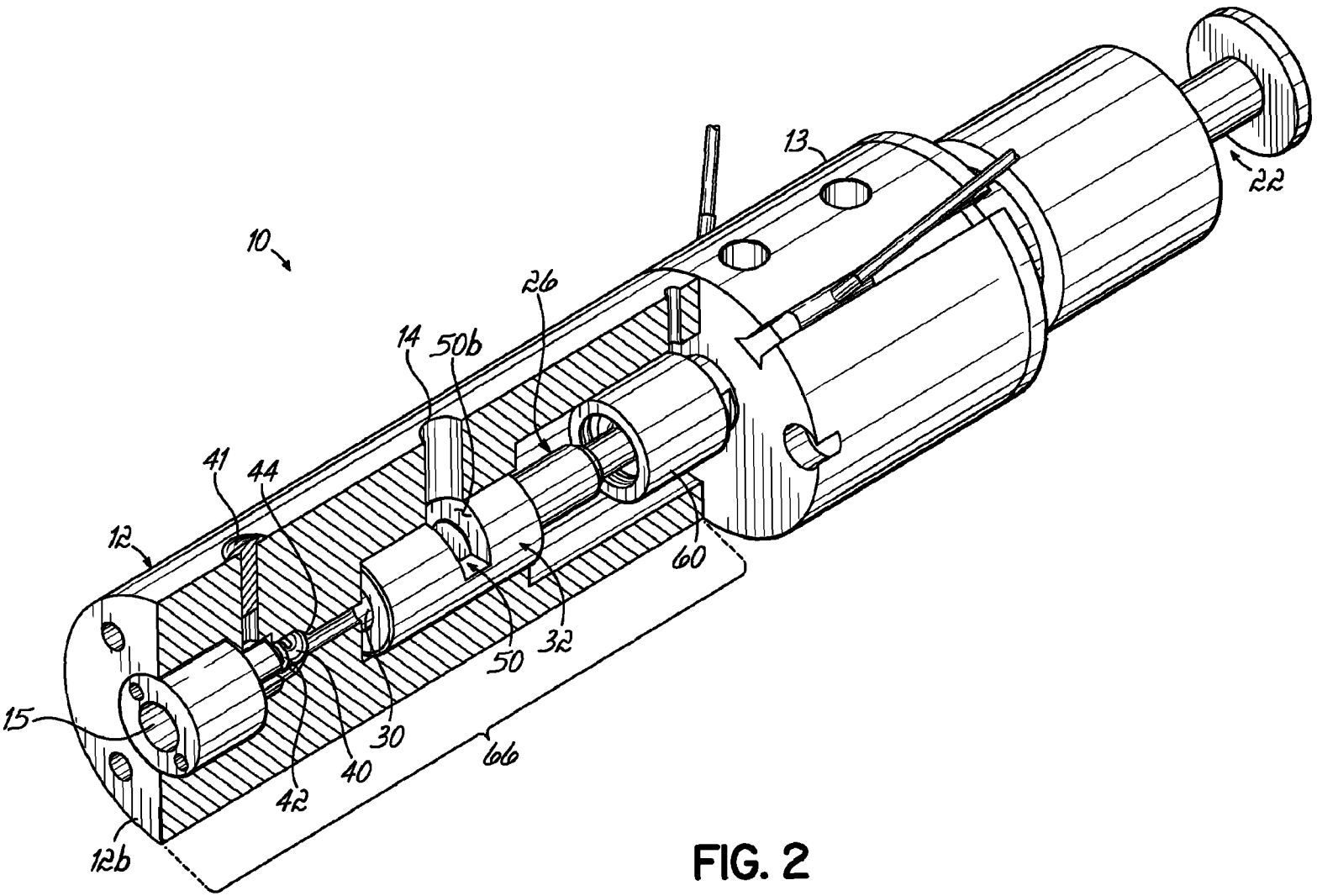
FIG. 2 is a perspective partially broken away view of the pump of FIG. 1.

With reference to the figures and, particularly, to FIGS. 1-2, an embodiment of a viscous fluid dispensing apparatus or pump 10 is illustrated. The pump 10 is designed to dispense a viscous fluid such as grease or silicone, for example, or any other fluid having a relatively high viscosity. Pump 10 includes a cylindrical pump body or housing 12 that is releasably coupled, as explained in further detail below, to an also cylindrical actuator body 13. The actuator body 13, in turn, is operatively coupled to a source of actuating power (not shown), such as, and without limitation, a hydraulic device, a pneumatic device, an electrical device (e.g., a linear motor) or a mechanical device (e.g., a cam). An inlet 14 in the housing 12 communicates with an interior thereof such that viscous fluid may be fed into the interior for controlled dispensing of the viscous fluid through an outlet 15 located at an axial end 12*b* of the housing 12. A pair of electrical wires 16*a*, 16*b* extend outwardly from the actuator body 13 and provide operative coupling between actuator body 13 and one or more actuating valves (e.g., air valves) 17*a*, 17*b* schematically represented in the figure, and which are in turn energized by one or more schematically represented switches 18*a*, 18*b*, such as reed switches, for example. The actuator body 13 includes an adjustment feature 22 at a proximal longitudinal end thereof that may be selectively set so as to vary the stroke length of a piston 26 disposed within the housing 12. The adjustment feature 22 may take different forms and include, for example, a threaded element, a détente, or any other element that permits selective adjustment of the stroke length of the piston 26.

Figure 3:
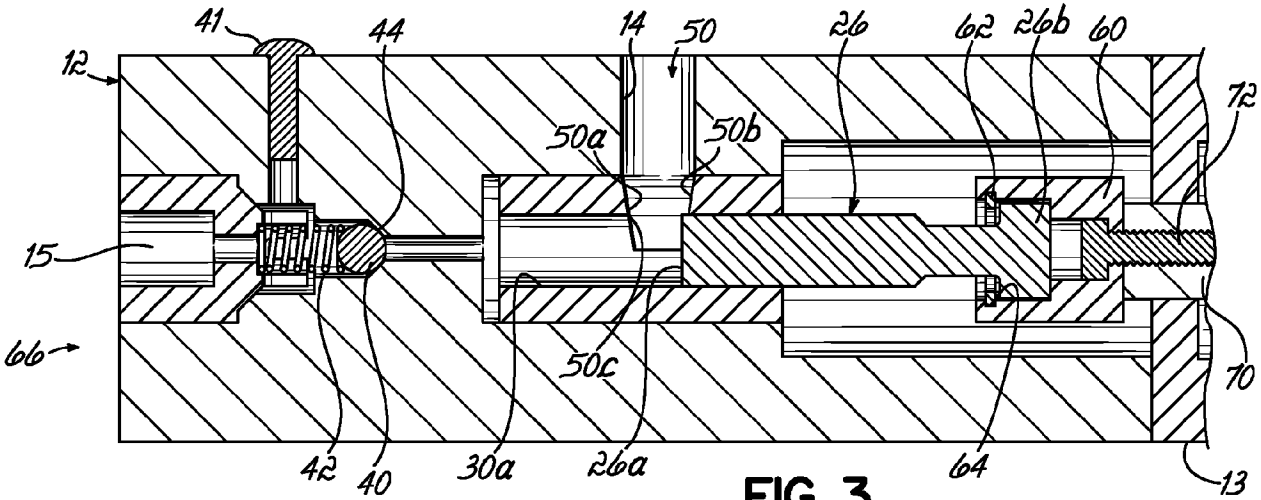
FIG. 3 is a cross-sectional view taken generally along line 3-3 of FIG. 1.

With continued reference to FIGS. 1-2, and further referring to FIG. 3, the pump 10 includes, as noted above, a piston 26 that is movable within the housing 12. More specifically, the piston 26 is slidably movable within an inner chamber 30 of a bushing 32, such that axial movement of the piston 26 toward outlet 15 is effective to force viscous fluid from within the inner chamber 30 and around a check valve 40 toward the outlet 15. In this regard, movement of the piston 26 toward outlet 15 is effective to impart on the viscous fluid a high enough pressure so as to overcome the force of a spring 42 supporting the check valve 40 against a valve seat 44 within housing 12. The interior space around check valve 40 can be purged and/or cleaned through a vent screw 41 (FIG. 1) extending through housing 12.

Bushing 32 has an opening, in this embodiment in the exemplary form of a slotted opening 50 providing direct access into the inner chamber 30 and which is positioned adjacent the inlet 14 directly between the inner chamber 30 and the inlet 14. In this regard, the slotted opening 50 fluidly communicates the inner chamber 30 directly with the inlet 14 which may, for example, be threaded to receive a cooperatively threaded fitting (not shown) coupling the pump 10 with a source of viscous fluid. Fluid communication between the inlet 14 and the inner chamber 30 is controlled by movement of the piston 26 within inner chamber 30. More specifically, and with further reference to FIG. 4, the piston 26 has a first position (FIG. 3) in which the inner chamber 30 is in fluid communication with the inlet 14, thereby permitting the flow of viscous fluid into the inner chamber 30, and a second position (FIG. 4) in which the piston 26 blocks fluid communication between the inner chamber 30 and the inlet 14.

In operation, movement of the piston 26 from the first position (FIG. 3) to the second position (FIG. 4) is effective, as discussed above, to force the viscous fluid from within the inner chamber 30 toward the outlet 15 through valve 40. The stroke length, i.e., the distance traveled by the piston 26 from the first to the second positions, along with the dimensions of inner chamber 30, determine the volume and pressure of the viscous fluid within chamber 30, thereby permitting controlled dispensing of the viscous fluid through outlet 15. To this end, as noted earlier, the stroke adjustment feature 22 may be used to selectively vary the stroke length, thereby permitting selective adjustment of the amount (i.e., volume) of viscous fluid being dispensed through outlet 15.

Movement of piston 26 from the second position (FIG. 4) to the first position (FIG. 3) is effective to generate a vacuum within inner chamber 30, thereby causing rapid refilling of inner chamber 30 with viscous fluid withdrawn from the source of viscous fluid through the inlet 14 into the inner chamber 30. In one aspect of this embodiment, smooth slidable movement of piston 26 within inner chamber 30 is facilitated by the shape of the slotted opening 50. More specifically, in the illustrated embodiment, the slotted opening 50 is defined by spaced apart walls 50*a*, 50*b* that are inwardly tapered toward the inner chamber 30. This geometrical arrangement of the walls 50*a*, 50*b* has been found to minimize the likelihood of a lip 50*c* of slotted opening 50 interfering with the distal end 26*a* of piston 26 during travel of the piston 26 from the first position (FIG. 3) to the second position (FIG. 4).

Figure 4:
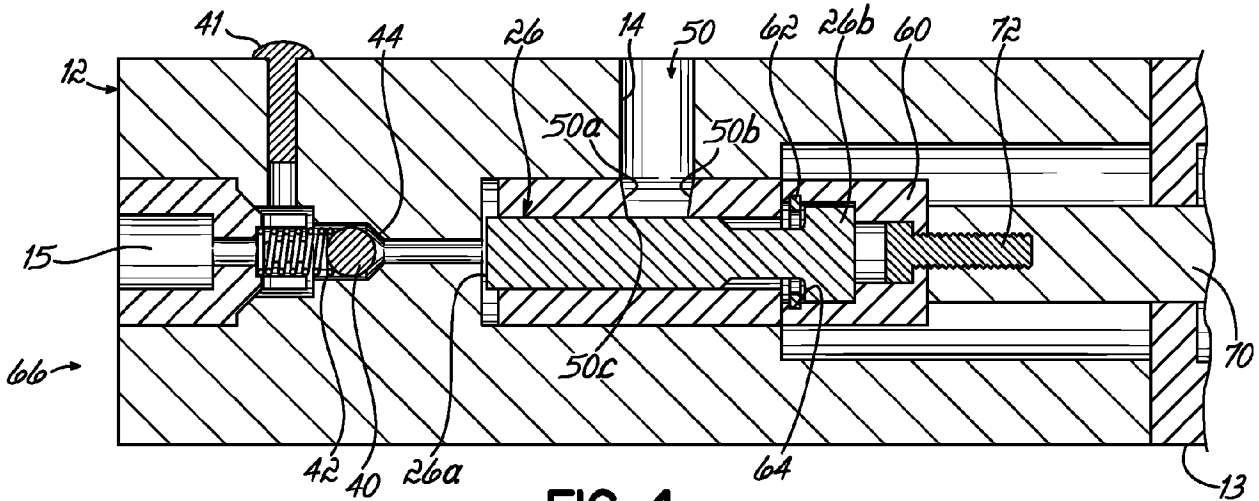
FIG. 4 is a view similar to FIG. 3, showing a piston of the pump of FIGS. 1-3 in a position different from that shown in FIG. 3.

With particular reference to FIGS. 2-4, the chosen shape and dimensions of slotted opening 50 of bushing 32 minimize alignment issues between the slotted opening 50 and the inlet 14. More specifically, as illustrated particularly in FIG. 2, the slotted opening 50 is formed so as to extend beyond the inlet 14 in a direction orthogonal to the longitudinal dimension of the pump 10. In this regard, fluid communication between the inner chamber 30 and inlet 14 is not overly sensitive to misalignment between the inlet 14 and slotted opening 50. Accordingly, in the illustrated embodiment, unobstructed fluid communication is permitted, for example, even when there is a misalignment of as much as about 50° relative to the position of coaxiality between the inlet 14 and slotted opening 50. Moreover, the relatively large size of slotted opening 50 relative to inlet 14 permits the flow of viscous fluid into the inner chamber 30 at pressures as low as, for example, about 10 psi (68947.5728 Pa).

Figure 5:
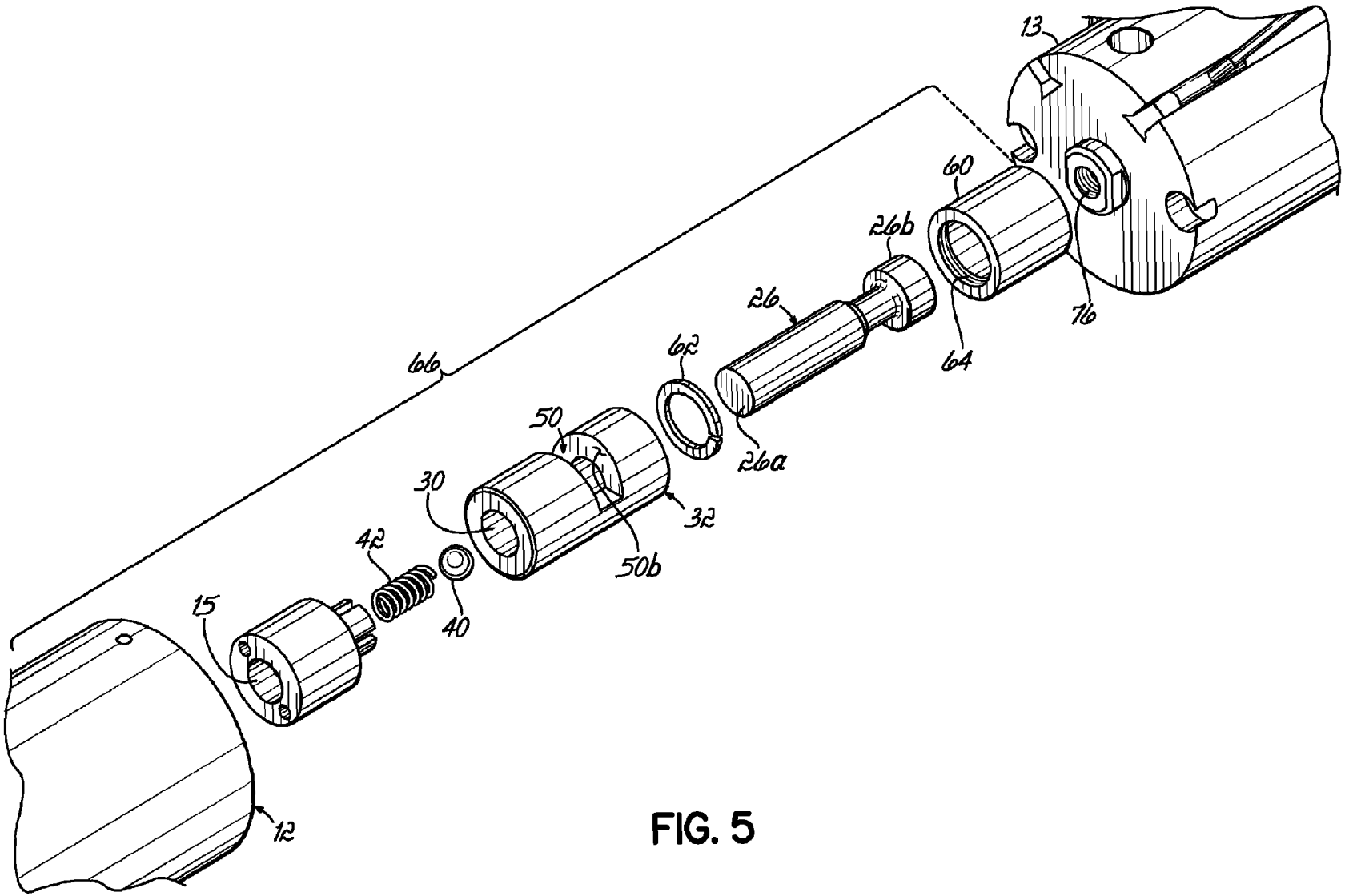
FIG. 5 is a perspective exploded view of a portion of the pump of FIGS. 1-4.

With continued particular reference to FIGS. 2-4, and further referring to FIG. 5, formation of the relatively wide (i.e., in a direction orthogonal to the longitudinal dimension of pump 10) slotted opening 50 is facilitated by construction of the bushing 32 outside of housing 12. In particular, construction of the pump 10, in the illustrated embodiment, includes forming the bushing 32 before it is inserted into the interior of housing 12. Accordingly, formation of the bushing 32 may include obtaining a generally tubular structure made of a hard material such as a metal (e.g., stainless steel or hardened A2 tool steel) or ceramic, with the general tubular structure having, for example, an outer diameter of about ¾ inches (19.05 mm), a length of about 1.45 inches (36.83 mm), and an inner diameter in the range of about 0.0625 inches (1.5875 mm) to about ½ inches (12.7 mm). Formation of the bushing 32 may further include defining (e.g., cutting or otherwise forming) an opening of a suitably chosen shape and dimensions, such as the illustrated slotted opening 50, with such shape and dimensions being determined independently of the shape or dimensions of the inlet 14. This is in stark contrast to conventional pumps that may have an inner structure (e.g., a sleeve) having a bore formed while the inner structure is in the interior of the pump. In such conventional pumps, the bore is formed in the inner structure through an inlet, such that the size and shape of the bore depends on the size and shape of the inlet. Further, in such conventional pumps, operation of the pump depends on almost perfect alignment between the bore formed in the inner structure and the inlet.

Once the bushing 32 is formed as discussed above, the bushing 32 may be inserted into the interior of housing 12 and the piston 26 may then be inserted into the inner chamber 30 of bushing 32, with a relatively close fit being provided between the piston 26 and the inner tubular wall 30*a* defining the inner chamber 30. This close fit may, for example, be such that the radial gap between the piston 26 and the inner tubular wall 30*a* does not exceed about 0.0002 inches (0.00508 mm). This close fit also provides an interior of housing 12, particularly inner chamber 30, that is notably free of soft seals (e.g., O-rings) which may have a tendency to wear off, thereby requiring replacement that would decrease the effective life span of the pump 10. More particularly, this close fit prevents the flow of viscous fluid through the gap radially separating the piston 26 from the inner tubular wall 30*a*. The piston 26 or at least the portion thereof disposed within the inner chamber 30 is made of a suitably chosen hard material such as a metal (e.g., stainless steel or hardened A2 tool steel) or ceramic, for example.

Construction of the pump 10 further includes securing a proximal end 26*b* of piston 26 within a tubular coupling sleeve 60 within housing 12. More specifically, the proximal end 26*b* is retained within the coupling sleeve 60 by a snap ring 62 that is in turn received in a groove 64 in the interior of coupling sleeve 60. This secured coupling between the coupling sleeve 60 and piston 26 permits axial movement of coupling sleeve 60 to result in corresponding axial movement of the piston 26 between the first and second positions (FIGS. 3 and 4, respectively). Jointly, the housing 12, piston 26, bushing 32, and coupling sleeve 60 define an interchangeable pump dispensing assembly generally designated in the figures with the numeral 66.

Movement of the coupling sleeve 60 is, in turn, driven by axial movement of a driving shaft 70 within the interior of actuator body 13 and which is coupled to the coupling sleeve 60. More specifically, the coupling sleeve 60 is coupled to the driving shaft 70 through a threaded element in the form, in this embodiment, of a centrally located, axially oriented bolt 72 protruding proximally from the coupling sleeve 60 and that is engaged with a correspondingly threaded bore 76 of shaft 70. Coupling between shaft 70 and coupling sleeve 60, accordingly, defines a releasable coupling between the housing 12 and the actuator body 13, with such coupling including, in the illustrated embodiment, rotation of the actuator body 13 and housing 12 relative to one another. This releasable coupling readily permits a simple, rapid interchange of the actuator body 13 with a selected one of several possible assemblies 66. This may be desirable, for example, to replace one assembly 66 with another one having a piston 26 and/or bushing 32 of different dimensions (e.g., a piston having a different diameter), thus capable of dispensing a different volume of viscous fluid or capable of dispensing the viscous fluid with a different pressure, for example, or while a specific assembly 66 is unavailable due to maintenance or repair. This illustrated coupling further facilitates rapid disassembly of the pump 10 for cleaning purposes, for example, and reduces the likelihood of alignment issues between the assembly 66 and actuator body 13.

With continued particular reference to FIGS. 2-5, and referring again to FIG. 1, in operation pump 10 automatically cycles to receive viscous fluid through inlet 14 and dispense controlled volumes of viscous fluid through outlet 15. More specifically, the switches 18*a*, 18*b* are configured to actuate when the piston 26 reaches the first position (FIG. 3) or the second position (FIG. 4). More specifically, in this embodiment, such actuation is effected by movement of the driving shaft 70 within the actuator body 13, to which the switches 18*a*, 18*b* are operatively connected. When the first switch 18*a* is actuated, for example, by movement of the piston 26 from the first position (FIG. 3) to the second position (FIG. 4), the switch 18*a* energizes the first valve 17*a* to which it is operatively coupled. The valve 17*a*, in turn, causes a reversal in the movement of the piston 26 back toward the first position (FIG. 3). When the piston 26 reaches the first position (FIG. 3), corresponding movement of the driving shaft 70 actuates the second switch 18*b* which, in turn, energizes the second valve 17*b* to which it is operatively coupled. The second valve 17*b*, in turn, causes reversal in the movement of the piston 26 back toward the second position (FIG. 4). This cycle is then repeated until it is selectively interrupted by the user.

While the figures and corresponding description refer to a "first position" and a "second position" of the piston 26 corresponding to the exemplary positions respectively illustrated in FIGS. 3 and 4, it is contemplated that alternative first and second positions may differ from those shown and still fall within the scope of the present disclosure, so long as they respectively correspond to positions where fluid communication is permitted and blocked between the inlet 14 and inner chamber 30 of bushing 32.

Also, while the illustrated embodiment includes two switches 18*a*, 18*b* and two valves 17*a*, 17*b*, it is contemplated that pump 10 may alternatively include any number of switches and/or valves and still fall within the scope of the present disclosure. For example, and without limitation, it is contemplated that an alternative embodiment of a pump 10 may include a single switch operatively coupled to one or more valves, and still be capable of facilitating the cycles described above for receiving viscous fluid through inlet 14 and dispensing controlled volumes of viscous fluid through outlet 15

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope of the general inventive concept.

What is claimed is:

1. A method of constructing a viscous fluid pump having a housing including an inlet for receiving viscous fluid and an outlet for dispensing viscous fluid, and a piston movable within an inner chamber of a bushing in the interior of said housing, the method comprising:

defining a slotted opening in the bushing to extend beyond the inlet in a direction orthogonal to the longitudinal dimension of the pump for providing direct access between the inner chamber and the inlet;

disposing the bushing with the slotted opening defined therein into the interior of the housing so as to place the inlet and the slotted opening in coaxial alignment along the longitudinal direction of the pump such that the inlet is in fluid communication with the inner chamber; and disposing the piston within the inner chamber of the bushing, such that movement of the piston selectively opens and closes fluid communication of the inlet with the inner chamber through the slotted opening.

2. The method of claim 1, wherein the housing, the bushing, and the piston jointly define a pump dispensing assembly, the method further comprising:

obtaining an actuator body; and releasably coupling the actuator body to the pump dispensing assembly to thereby define an operative coupling of the actuator body with the piston.

3. The method of claim 2, wherein releasably coupling the actuator body to the pump dispensing assembly includes rotating the actuator body relative to the housing.

4. The method of claim 2, further comprising:

securing the piston within the housing; and maintaining the interior of the housing free of soft seals when the piston is secured therein.

5. A viscous fluid pump comprising:

a housing having an inlet for receiving viscous fluid and an outlet for dispensing viscous fluid;

a bushing within said housing, said bushing having a slotted opening proximate said inlet and providing direct access between an inner chamber of said bushing and said inlet, said slotted opening extending beyond said inlet in a direction orthogonal to the longitudinal dimension of the pump; and a piston movable within said inner chamber, said piston having a first position in which said inlet is in fluid communication with said inner chamber through said slotted opening and a second position in which said inlet is not in fluid communication with said inner chamber, wherein said inlet and said slotted opening are coaxial along the longitudinal direction of the pump.

6. The pump of claim 5, wherein said housing defines an interior, said interior of said housing being free of soft seals.

7. The pump of claim 5, wherein said slotted opening defines a pair of opposed, spaced apart walls, said walls being inwardly tapered toward said inner chamber.

8. The pump of claim 5, wherein movement of said piston from the second position to the first position is configured to generate a vacuum in said inner chamber effective to withdraw viscous fluid through said inlet.

9. The pump of claim 5, wherein said piston is radially spaced from said bushing by a distance not exceeding about 0.0002 inches.

10. The pump of claim 5, wherein at least one of said piston or said bushing is made of a metal or a ceramic.

11. The pump of claim 5, further comprising:

a check valve proximate said outlet, movement of said piston from the first position to the second position being effective to move viscous fluid from said inner chamber toward said check valve.

12. The pump of claim 5, further comprising:

an air valve operatively coupled to said piston and effective to move said piston between the first and second positions; and a switch operatively coupled to said air valve for energizing said air valve, said switch being actuatable by movement of said piston from the first position to the second position or from the second position to the first position so as to cause said air valve to move said piston, respectively, back toward the first position or toward the second position.

13. The pump of claim 5, wherein movement of said piston between the first and second positions defines a stroke of said piston, the pump further comprising:

a stroke adjustment mechanism for selectively varying the length of the stroke.

14. The pump of claim 5, wherein said piston has a proximal end and an opposed distal end, said distal end being disposed within said inner chamber, and said housing, said bushing, and said piston jointly define a pump dispensing assembly, the pump further comprising:

an actuator body operatively coupled to said proximal end of said piston and removably coupled to said pump dispensing assembly for permitting selective coupling of said actuator body with another pump dispensing assembly.

15. The pump of claim 14, wherein coupling between said actuator body and said pump dispensing assembly includes an axially oriented threaded element.

16. The pump of claim 5, wherein said outlet is located at an axial end of said housing.

17. The fluid pump of claim 5, wherein the inlet and the slotted opening are in fluid communication up to an axial misalignment of about 50° between the inlet and the slotted opening along the direction orthogonal to the longitudinal direction.

* * * * *